US006026950A

United States Patent [19]

Wisniewski

[11] Patent Number: 6,026,950

[45] **Date of Patent: *Feb. 22, 2000**

[54] EYEGLASS CASE WITH GLASSES-ENGAGING BUMP

[75] Inventor: Mark S. Wisniewski, Blackstone, Mass.

[73] Assignee: Justin Case, Inc., North Smithfield, R.I.

[ * ] Notice: This patent is subject to a terminal disclaimer.

[21] Appl. No.: 08/972,417

[22] Filed: Nov. 18, 1997

[51] Int. Cl.[7] ..... A45C 11/04

[52] U.S. Cl. ..... 206/6

[58] Field of Search ..... 206/5, 6; D3/265, D3/266

[56] References Cited

U.S. PATENT DOCUMENTS

| | | | |
|---|---|---|---|
| 339,267 | 4/1886 | Closs | 206/6 |
| 536,557 | 3/1895 | White | 206/6 |
| 559,438 | 2/1896 | Closs | 206/6 |
| 624,603 | 5/1899 | Zoerb et al. | 206/6 |
| 1,339,330 | 2/1920 | Goelkel | 206/6 |
| 2,047,652 | 7/1936 | Sproull | 206/6 |
| 2,057,801 | 10/1936 | Swanson | 206/6 |
| 2,148,637 | 2/1939 | Oldham | 206/6 |
| 2,184,408 | 12/1939 | Bouchard | 206/6 |
| 2,187,178 | 1/1940 | Schutz | 206/6 |
| 2,203,402 | 6/1940 | Bausch | 206/6 |
| 2,332,266 | 10/1943 | Segal | 206/6 |
| 2,642,987 | 6/1953 | Castelli | 206/6 |
| 3,000,417 | 9/1961 | Goldstein | 206/5 |

FOREIGN PATENT DOCUMENTS

| | | | |
|---|---|---|---|
| 1174493 | 3/1959 | France | 206/6 |
| 1736409 | 5/1992 | U.S.S.R. | 206/6 |
| 522357 | 6/1940 | United Kingdom | 206/6 |

*Primary Examiner*—Byron P. Gehman
*Attorney, Agent, or Firm*—Salter & Michaelson

[57] ABSTRACT

An eyeglass case with two selectively relatively openable and closable housing elements, one of which includes a bump extending toward the other and adapted to accept therearound a clip-on pair and thereover a regular pair.

8 Claims, 3 Drawing Sheets

EYEGLASS CASE WITH GLASSES-ENGAGING BUMP

FIELD

This invention relates to eyeglass cases.

BACKGROUND OF THE INVENTION

Eyeglass cases of two types are well known in the art. In one type, a transverse opening at one longitudinal end allows insertion and removal of a pair of spectacles. In the other, a pair of elements relatively rotatable about an axis adjacent one set of their longitudinal edges is openable thereabout, spring means selectively cooperating with the said elements biasing them toward a closed position.

SUMMARY OF THE INVENTION

I have discovered that an improved case may be provided by including between a pair of longitudinally elongated housing elements selectively relatively movable to close or open the case a centrally positioned bump extending from one of the housing elements toward the other and adapted to be gripped around the bump's outside by a pair of clip-on glasses, and to support on the inner surface of the bump a pair of regular glasses.

In its narrower aspects, the invention will appear from the following description and claims.

PREFERRED EMBODIMENT

The presently preferred embodiment is described in structure and operation in the light of the drawings. Drawings FIG. 1A is a front plan view showing the case open, including a pair of clip-on glasses supported therein and a pair of conventional glasses.

STRUCTURE

Figure 1A:
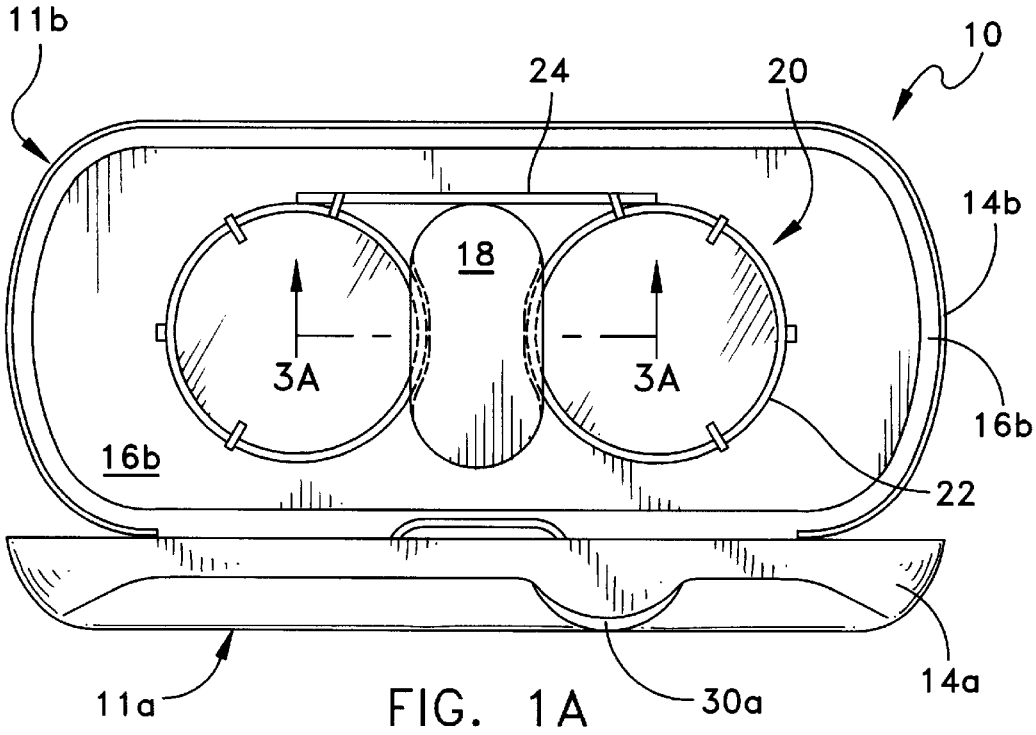
FIG. 1B is a perspective view of the eyeglass case of FIG. 1A.
Figure 1B:
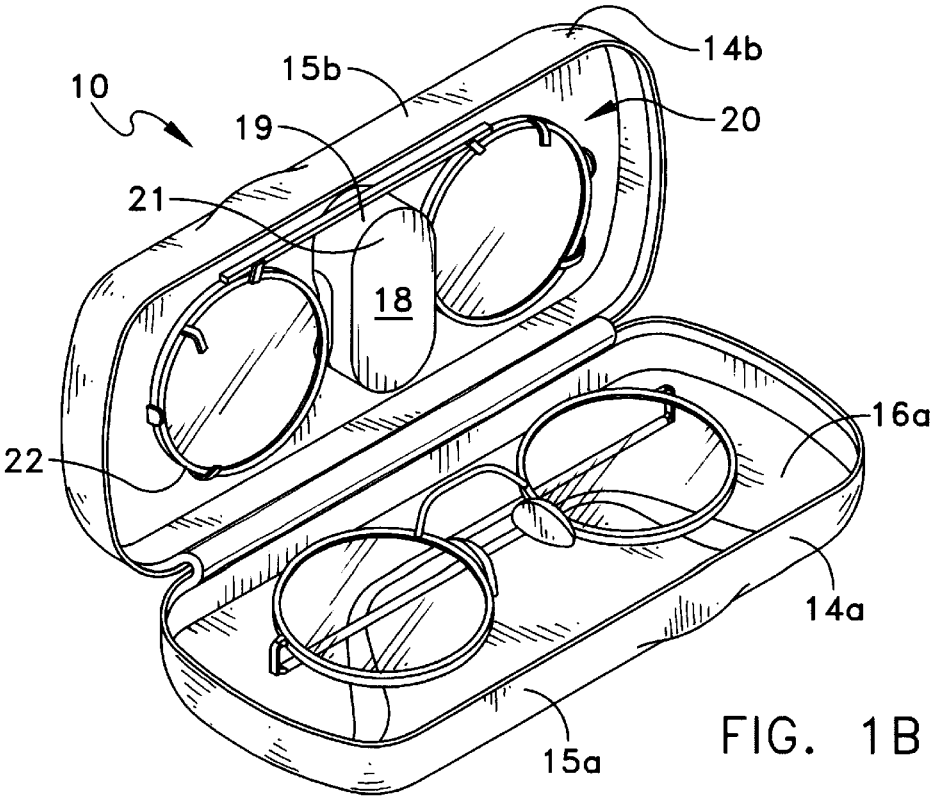
Figure 2A:
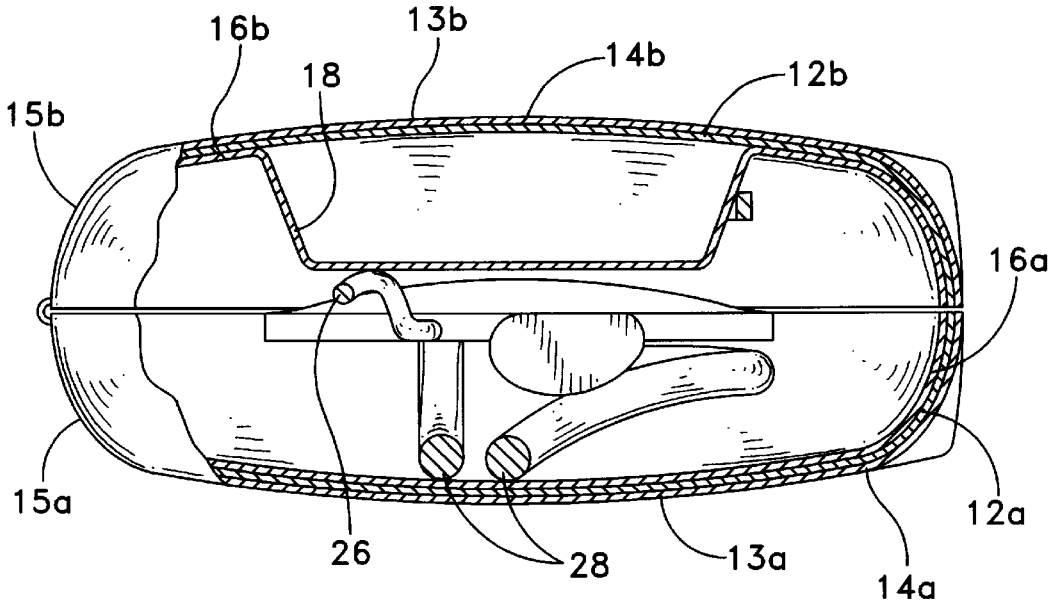
FIG. 2A is a vertical sectional view taken at 2A–2A of FIG. 5A.

Referring to FIGS. 1A and 1B, a glasses (spectacles) case is indicated generally at 10. The case includes a first elongated housing element 11b having a top wall 13*b* and a side wall 15*b*, and a second elongated housing element 11*a* having a bottom wall 13*a* and a side wall 15*a*. Structural integrity is provided by a pair of inner elements 12*a* and 12*b* formed from mild steel. Each portion 12*a* and 12*b* is provided with an adhered leatherette protective plastic layer elements respectively 14*a* and 14*b*, as best shown in FIG. 2A. Adhered to inner surfaces of elements 12*a* and 12*b* is a unitary element indicated generally at 16, and provided with portions 16*a* and 16*b* respectively so adhered.

Element 16 is of plastic, with a polystyrene base and extending inwardly of the case 10 from said base suitably a nylon flock. Many (e.g., eighteen) elements 16 are made simultaneously from a larger sheet, vacuum forming bumps 18 in portions 16*b*, but no such bumps in portions 16*a*, simultaneously also then cutting out the many elements 16 of a sheet.

Figure 3A:
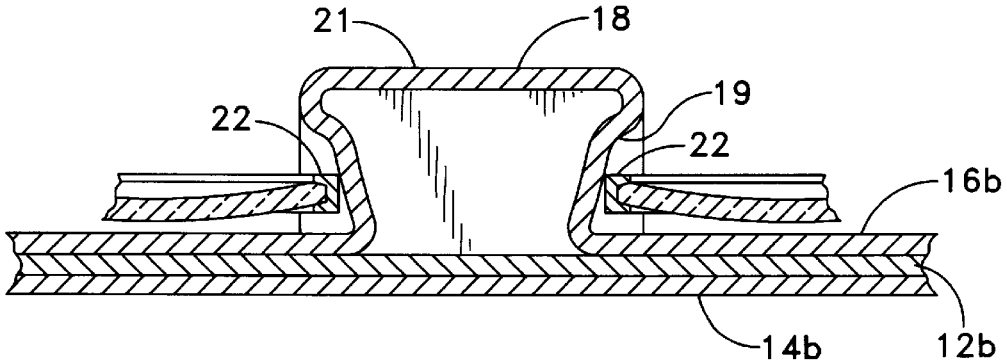
FIG. 3A is a vertical sectional view taken at 3A–3A of FIG. 1A.

As shown in FIGS. 1A and 1B, a pair of clip-on spectacles indicated generally at 20 is resiliently held at its rims 22 against (FIG. 3A) the tapering (at seven degrees) FIG. 3A of the upstanding wall of bump 18 by the spring force of bridge 24.

In FIG. 2A is shown how a second pair of ordinary spectacles is held above bump 18 to prevent movement of the spectacles, its bridge 26 resting on the upper surface of bump 18, and its temples 28 being held against the inner surface of portion 16*a* by the overall internal spring force of that folded and compressed second pair.

Figure 4:
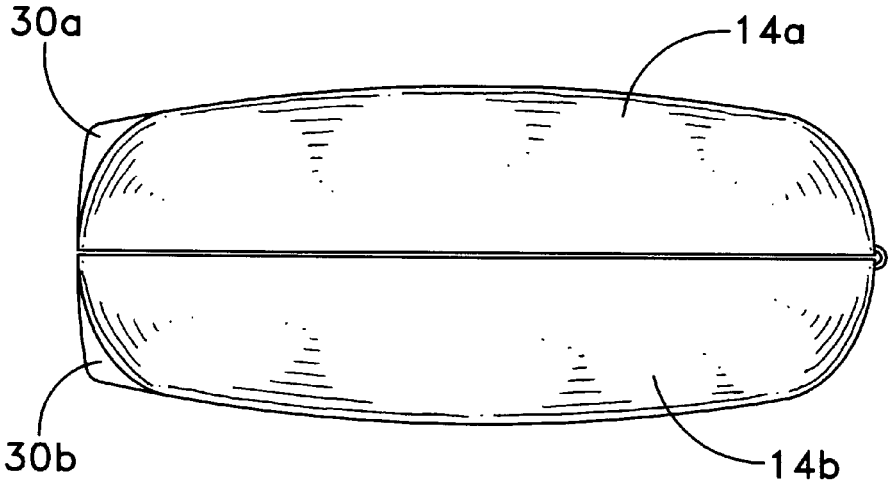
FIG. 4 is an end elevational view of the closed case.
Figure 5A:
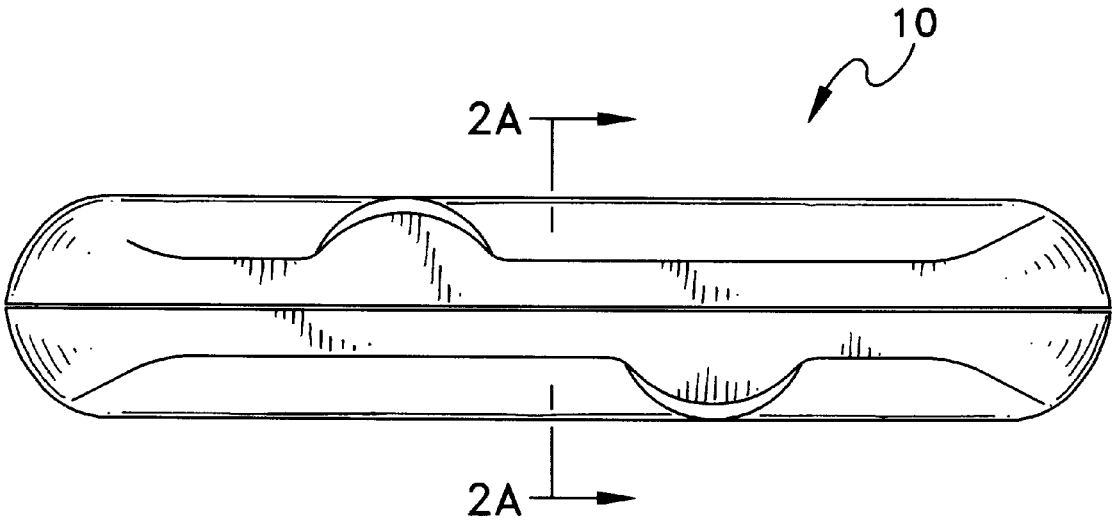
FIG. 5A is a side elevational view of the closed case.

FIG. 4 illustrates a pair of thumb press protrusions 30*a* and 30*b*, longitudinally as well as transversely spaced (FIG. 5A), with generally vertical thumb-engaging surfaces outwardly of case 10. The outer peripheries of said surfaces are generally elliptical.

Opener protuberances 30*a* and 30*b* are longitudinally spaced about a third of the overall length of case 10, and have each approximately planar surfaces, in a vertical plane and defined by congruent oppositely directed portions of ellipses.

OPERATION

The invention makes convenient carrying in one case two pairs of glasses, a clip-on held in position on bump 18, and a regular pair resting onbump 18, preferably resiliently held by its own folded spring force thereagainst.

OTHER EMBODIMENTS

Other embodiments will occur to those skilled in the art.

For example, other materials may be used for the different elements of the invention. The thumb bumps may be omitted. The space above bump 18 may be left too great for second frame spring action.

What is claimed is:

1. A glasses case comprising:

a first elongated housing element including a top wall and a side wall, said first elongated housing element having a depth sufficient to retain a pair of clip-on glasses having a pair of lenses and a bridge a second elongated housing element including a bottom wall and a side wall, said second elongated housing element having a depth sufficient to retain a pair of glasses having a pair of lenses, a bridge and temples, the side wall of said first housing element being joined to the side wall of said second housing element along a corresponding side thereof such that said first and second housing elements are selectively closable about a longitudinal axis to move the case between a closed position wherein the side walls of said first and second housing elements engage each other and an open position wherein at least a portion of the side walls of the first and second housing elements are spaced from each other, said first housing element having a centrally disposed bump formed on an inner surface thereof. said bump extending toward said second housing element and including an upstanding wall and an upper surface. the upstanding wall of said bump being constructed and arranged to engage the lenses of the clip-on glasses at a side edge thereof so as to securelv hold the clip-on glasses within said first housing element in both the open position and the closed position, the upper surface of said bump being constructed and arranged to engage the pair of glasses having temples in the closed position so as to prevent movement of the pair of glasses having temples.

2. The case of claim 1 in which said bump is formed in a lining element of said first housing element.

3. The case of claim 2 wherein a portion of said upstanding wall is disposed at an angle to provide decreasing width to said bump thereacross.

4. The case of claim 3 in which said portion of said upstanding wall is disposed at an angle of seven degrees to the axis of said bump.

5. The case of claim 1 in which said bump is vacuum formed in a plastic case liner.

6. The case of claim 1 in which the pair of glasses is held in place by a spring force of said bump.

7. The case of claim 1 in which an outer surface of the side wall of said first housing member is aligned with an outer surface of the side wall of said second housing member in the closed position.

8. The case of claim 8 in which the side walls each include a protuberance on the outer surface thereof, the protuberances being offset from each other in order to facilitate opening of the case.

* * * * *